US005392742A

United States Patent [19]

Rush et al.

[11] Patent Number: 5,392,742

[45] Date of Patent: Feb. 28, 1995

[54] HEATED INTAKE MANIFOLD FOR FOUR STROKE OUTBOARD MOTOR

[76] Inventors: William B. Rush, 40160 N. Crawford Rd., Wadsworth, Ill. 60083; Jeffrey F. Wagner, 3924 Woodlawn Dr., Gurnee, Ill. 60031

[21] Appl. No.: 106,277

[22] Filed: Aug. 13, 1993

[51] Int. Cl.[6] ..... F02B 75/22

[52] U.S. Cl. ..... 123/184.61; 277/236

[58] Field of Search ..... 123/193.5, 193.3, 52 M, 123/52 MC, ; 277/235 B, 236, 173, 174, 177, 135

[56] References Cited

U.S. PATENT DOCUMENTS

| | | | |
|---|---|---|---|
| 2,303,114 | 11/1942 | Egger | 277/236 |
| 3,007,600 | 11/1961 | Horner | 277/236 |
| 3,313,553 | 4/1967 | Gastineau | 277/236 |
| 3,479,063 | 11/1969 | Raver | 277/236 |
| 3,965,873 | 6/1976 | Konomi et al. | 123/52 M |
| 4,114,907 | 9/1978 | Abbes et al. | 277/236 |
| 4,356,798 | 11/1982 | Sakaoka et al. | 123/52 M |
| 4,372,565 | 2/1983 | Lien | 277/236 |
| 4,515,115 | 5/1985 | Okubo | 123/52 M |
| 4,717,808 | 1/1988 | Cyll et al. | 219/206 |
| 4,717,813 | 1/1988 | Berg et al. | 219/341 |
| 4,865,004 | 9/1989 | Widmer et al. | 123/541 |

*Primary Examiner*—E. Rollins Cross
*Assistant Examiner*—M. Macy

[57] ABSTRACT

Disclosed herein is a four stroke internal combustion engine comprising a cylinder head fabricated of metal and including an intake manifold mounting surface, and an intake passage including a port in the intake manifold mounting surface, an intake manifold fabricated of metal and including a cylinder head mounting surface, and an intake passage including a port in the cylinder head mounting surface, a fastener connecting the intake manifold to the cylinder head with the ports in registration and with the cylinder head mounting surface and the intake manifold mounting surface in metallic surface-to-surface contact, and a seal between the intake manifold mounting surface and the cylinder head mounting surface.

2 Claims, 1 Drawing Sheet

HEATED INTAKE MANIFOLD FOR FOUR STROKE OUTBOARD MOTOR

BACKGROUND OF THE INVENTION

The invention relates generally to four stroke engines and particularly to arrangements for supplying fuel in a fuel/air mixture to the combustion space defined in part by the cylinder head of the engine.

It is common in four stroke internal combustion engines to employ an intake manifold between the cylinder head and a carburetor or other charge forming means so as to supply a fuel air mixture through the intake manifold to the combustion space defined at least in part by the cylinder head. However, during engine operation, and particularly during starting and low speed operation in cold water, liquid fuel can collect in the intake manifold and find its way to the crankcase, thereby thinning the engine oil supply and causing poor engine durability.

Attention is directed to the following U.S. Patents:

| U.S. Pat. Nos. | | |
|---|---|---|
| 4,717,808 | Cyll, et al. | January 5, 1988 |
| 4,717,813 | Berg, et al. | January 5, 1988 |
| 4,865,004 | Widmer, et al. | September 12, 1989 |

SUMMARY OF THE INVENTION

The invention provides a four stroke internal combustion engine comprising a cylinder head fabricated of metal and including an intake manifold mounting surface, and an intake passage including a port in the intake manifold mounting surface, an intake manifold fabricated of metal and including a cylinder head mounting surface, and an intake passage including a port in the cylinder head mounting surface, means for connecting the intake manifold to the cylinder head with the ports in registration and with the cylinder head mounting surface and the intake manifold mounting surface in metallic surface-to-surface contact, and means for sealing the connection.

In one embodiment, the sealing means includes an annular groove surrounding the port in one of the cylinder head mounting surface and the intake manifold mounting surface, and an O-ring located in the groove and sealingly engaged with both the cylinder head and the intake manifold.

In one embodiment, the sealing means includes an anaerobic liquid seal.

Other features of and advantages of the invention will become apparent to those skilled in the art upon review of the following detailed description, claims, and drawings.

THE DRAWINGS

Figure 1:
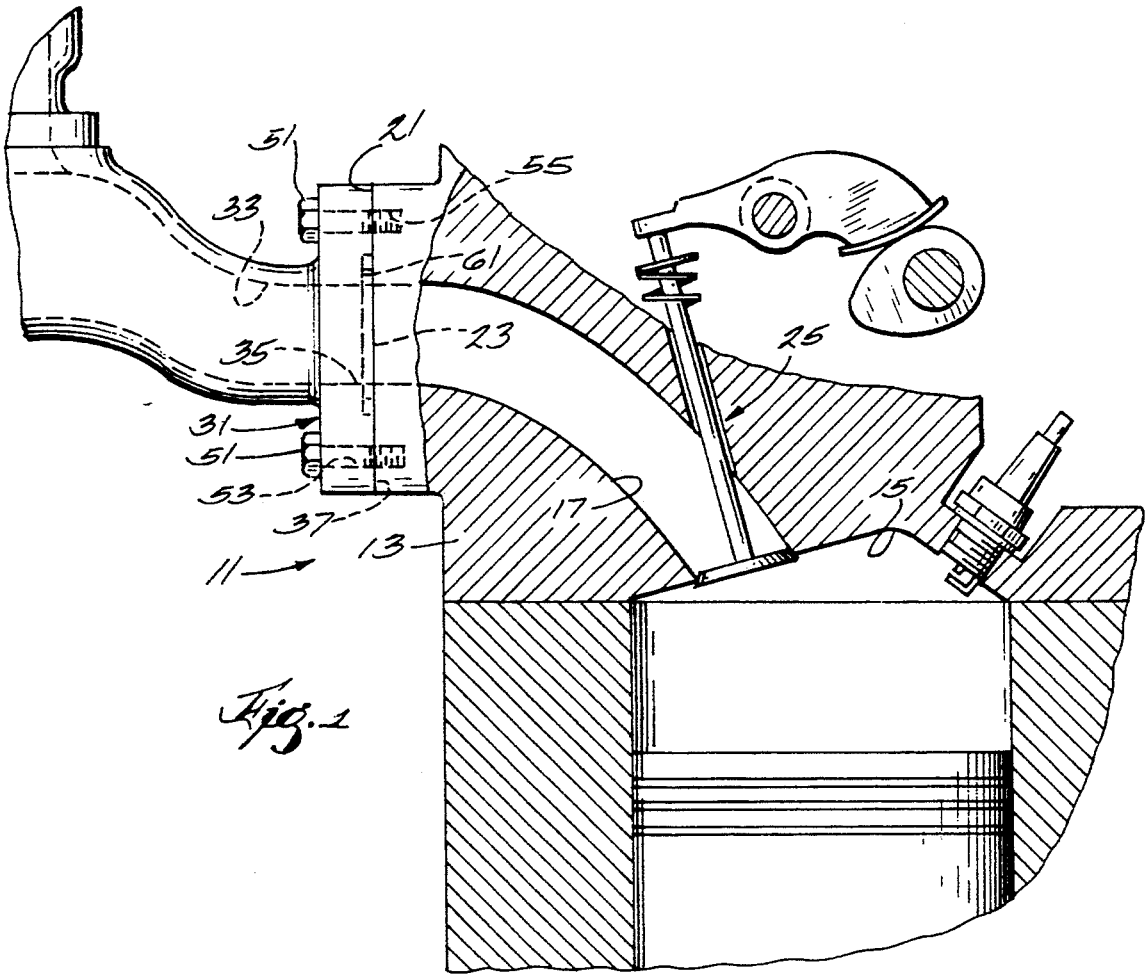
FIG. 1 is a fragmentary view, paritally in section of a portion of an internal combustion engine embodying various of the features of the invention.
Figure 2:
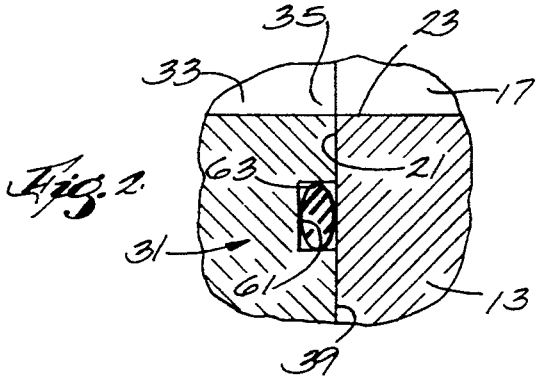
FIG. 2 is an enlarged fragmentary view, partially in section of a portion of FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown fragmentarily in the drawings is a four stroke internal combustion engine 11 which preferably forms part of an outboard motor and which includes a cylinder head 13 which is fabricated of metal, such as aluminum, and which includes a combustion recess 15 and an air/fuel mixture inlet passage 17 communicating between the combustion recess and an intake manifold mounting surface 21. The air/fuel mixture inlet passage 17 terminates in a port 23 in the intake manifold mounting surface 21. The air/fuel mixture intake passage 17 is opened and closed by a suitably operated intake valve 25.

Also included in the engine is an intake manifold 31 which is fabricated of metal, such as aluminum, and which includes a air/fuel mixture inlet passage 33 terminating, at one end, in a port 35 in a cylinder head mounting surface 37 and communicating, at its other end, with a suitable charge forming means, such as a carburetor (not shown).

The engine also includes means for fixedly connecting the intake manifold 31 and the cylinder head 13 with the inlet passage ports 23 and 35 in registry and with the cylinder head 13 and the intake manifold 31 in metallic surface-to-surface contact therebetween so as to facilitate heat transfer therebetween, together with means for sealing the connection between the intake manifold 31 and the cylinder head 13 against loss of the air/fuel mixture flowing therethrough and from entry of air from the atmosphere.

While various arrangements can be employed, in the disclosed construction, the mounting means includes a plurality of fasteners, such as the bolts 51, which extend through apertures 53 in the cylinder head mounting surface 37 of the intake manifold 31 and into threaded apertures 55 in the intake manifold mounting surface 21 of the cylinder head 13. In addition, while other sealing arrangements could be employed, in the disclosed construction, the mounting means includes an annular groove 61 surrounding the port 23 or 35 in one of the cylinder head mounting surface 37 and the intake manifold mounting surface 21, together with an O-ring 63 located in the groove 61 and sealingly engaging both the cylinder head 13 and the intake manifold 31.

Still further in addition, as already noted, the cylinder head mounting surface 37 and the intake manifold mounting surface 21 are mounted to each other in at least partial metal-to-metal contact so as to facilitate heat transfer from the cylinder head 13 to the intake manifold 31.

Alternatively, other means can be employed for sealing the connection between the intake manifold 31 and the cylinder head 13. In this regard, the intake manifold 31 and the cylinder head 13 can be sealed with an anaerobic liquid seal while still obtaining, in effect, metal-to-metal contact to facilitate heat transfer from the cylinder head 13 to the intake manifold 31.

In operation, the heat generated in the combustion recess 15 is transmitted from the metallic cylinder head 13 through the metallic surface-to-surface contact and into the metallic intake manifold 31 to heat or warm the incoming fuel/air mixture and thereby reduce or substantially eliminate any deposit or accumulation of liquid fuel along the walls of the intake manifold 51.

Various of the features of the invention are set forth in the following claims.

We claim:

1. A four stroke internal combustion engine comprising a cylinder head fabricated of metal and including a planar intake manifold mounting surface, and an intake passage including a port in said intake manifold mounting surface, an intake manifold fabricated of metal and including a planar cylinder head mounting surface, and an intake passage including a port in said cylinder head mounting surface, means for connecting said intake manifold to said cylinder head with said ports in registration and with said cylinder head mounting surface and said intake manifold mounting surface in metallic surface-to-surface contact, an annular groove in surrounding and outwardly spaced relation to said port in one of said planar surfaces and including a bottom surface spaced from said one of said surfaces, and two cylindrical walls in concentric relation to each other and extending between said one planar surface and said bottom surface, and an O-ring located in said groove and sealingly engaged with both said cylinder head and said intake manifold.

2. A four stroke internal combustion engine comprising a cylinder head fabricated of metal and including a planar intake manifold mounting surface, and an intake passage including a port in said intake manifold mounting surface, an intake manifold fabricated of metal and including a planar cylinder head mounting surface, and an intake passage including a port in said cylinder head mounting surface, means for connecting said intake manifold to said cylinder head with said ports in registration and with said cylinder head mounting surface and said intake manifold mounting surface in metallic surface-to-surface contact, and an anaerobic liquid seal between said planar surfaces.

* * * * *

UNITED STATES PATENT AND TRADEMARK OFFICE

CERTIFICATE OF CORRECTION

PATENT NO. : 5,392,742

DATED : February 28, 1995

INVENTOR(S) : Rush, et al.

It is certified that error appears in the above–identified patent and that said Letters Patent is hereby corrected as shown below:

On the cover page, add the following:

Assignee: OUTBOARD MARINE CORPORATION
Waukegan, Illinois

Signed and Sealed this

Fifth Day of September, 1995

Bruce Lehman

*Attest:*

BRUCE LEHMAN

*Attesting Officer*

*Commissioner of Patents and Trademarks*